US007207664B2

(12) United States Patent
Junhua

(10) Patent No.: US 7,207,664 B2
(45) Date of Patent: Apr. 24, 2007

(54) ACTUATOR DEVICE, LIQUID EJECTION HEAD, AND METHOD OF INSPECTING THE SAME

(75) Inventor: Chang Junhua, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/381,083

(22) Filed: May 1, 2006

(65) Prior Publication Data

US 2006/0256166 A1 Nov. 16, 2006

Related U.S. Application Data

(62) Division of application No. 10/436,443, filed on May 13, 2003, now Pat. No. 7,114,797.

(30) Foreign Application Priority Data

May 13, 2002 (JP) ..... P2002-137280
May 9, 2003 (JP) ..... P2003-131408

(51) Int. Cl.
*B41J 2/045* (2006.01)

(52) U.S. Cl. ..... 347/71

(58) Field of Classification Search ..... 347/68–72
See application file for complete search history.

(56) References Cited

U.S. PATENT DOCUMENTS 5,886,717 A 3/1999 Satake et al.
5,912,526 A 6/1999 Okawa et al.
6,781,290 B2 8/2004 Kurihara et al.

FOREIGN PATENT DOCUMENTS

JP 01-214009 A 8/1989
JP 06-008423 A 1/1994
JP 06-166178 A 6/1994
JP 07-227964 A 8/1995
JP 11-227186 A 8/1999
JP 2-289832 A 5/2006

*Primary Examiner*—Julian D. Huffman
(74) *Attorney, Agent, or Firm*—Sughrue Mion, PLLC

(57) ABSTRACT

A substrate is formed with a pressure generating chamber. A vibration plate is joined to the substrate so as to form a part of the pressure generating chamber. A first piezoelectric element is disposed on a part of the vibration plate facing the pressure generating chamber. The first piezoelectric element includes a first electrode disposed on the part of the vibration plate, a first piezoelectric layer laminated on the first electrode, a second electrode disposed on the first piezoelectric layer, a second piezoelectric layer laminated on the first piezoelectric layer while covering the second electrode, and a third electrode disposed on the second piezoelectric layer and electrically connected to the first electrode. A second piezoelectric element is disposed on the vibration plate, and including at least the first piezoelectric layer, the second electrode, and the second piezoelectric layer, such that an electrostatic capacity of either the first piezoelectric layer or the second piezoelectric layer is adapted to be measured. The second piezoelectric element is arranged adjacent to the first piezoelectric element in a first direction corresponding to a shorter width of the first piezoelectric element.

5 Claims, 6 Drawing Sheets

ACTUATOR DEVICE, LIQUID EJECTION HEAD, AND METHOD OF INSPECTING THE SAME

This is a divisional of application Ser. No. 10/436,443 filed May 13, 2003 now U.S. Pat. No. 7,114,797. The entire disclosure is hereby incorporated by reference.

BACKGROUND OF THE INVENTION

The present invention relates to an actuator device, comprising piezoelectric elements that are deformed by the application of a voltage to a piezoelectric layer. In particular, the present invention relates to a liquid ejection head wherein a part of a pressure generating chamber, which communicates with a nozzle orifice through which liquid droplets are ejected, is formed of a vibration plate, on the surface of which piezoelectric elements are disposed, so that liquid droplets are ejected when the piezoelectric elements are deformed. The present invention also relates to a method of inspecting such an actuator device and such a liquid ejection head.

As one example of the liquid ejection head, there is an ink jet recording head wherein a part of a pressure generating chamber, which communicates with a nozzle orifice through which ink droplets are ejected, is formed of a vibration plate, on the surface of which an actuator device comprising piezoelectric elements of flexure vibration mode are disposed, so that ink droplets are ejected when the piezoelectric elements are deformed.

For such an ink jet recording apparatus, the piezoelectric elements can be mounted using a relatively simple process, whereby either a green sheet composed of a piezoelectric material and corresponding in shape to that of the pressure generating chamber, is glued to the vibration plate, or coated on the vibration plate by printing, and the resultant structure is baked. With such an apparatus, however, high frequency ejection is difficult, and in order to resolve this problem, as is disclosed in Japanese Patent Publication No. 2-289352A (see FIG. 5, and page 6, line 9 of the lower left column through line 14 of the lower right column), a two-layer piezoelectric member is employed and the deformed amount of the piezoelectric element is increased.

Such an ink jet recording head, comprising multi-layer, laminated piezoelectric elements, enables relatively high frequency ink ejection. However, since when piezoelectric layers are used to form a piezoelectric element, thickness errors occur and the characteristics of the layers are not uniform, and when printing is used for coating the piezoelectric layers, thickness errors, especially, tend to be increased. Therefore, before a piezoelectric element is formed, the electrostatic capacities of the piezoelectric layers are measured, to identify the relevant characteristics, and in accordance with the characteristics, an appropriate drive waveform is selected to drive the piezoelectric element.

However, for an ink jet recording head comprising piezoelectric elements having the multi-layer structure, since the lower common electrode and the upper common electrode of each piezoelectric element are electrically connected, even when the electrostatic capacities of the piezoelectric layers are to be measured after the manufacturing process has been completed, only the overall electrostatic capacity of the piezoelectric layers can be measured. As a result, the characteristics of the piezoelectric element can not be accurately identified.

Namely, even for piezoelectric elements for which the piezoelectric layers have the same overall electrostatic capacity, the deformation characteristics differ depending on the ratio of the thickness of the lower piezoelectric layer to the thickness of the upper piezoelectric layer. Therefore, the characteristics of the piezoelectric element can not be accurately identified merely by referring to the overall electrostatic capacity of the piezoelectric layers.

These problems also apply for an actuator device that is mounted on a liquid ejection head, such as a liquid crystal ejection head or a coloring material ejection head.

SUMMARY OF THE INVENTION

It is therefore an object of the present invention to provide an actuator device and a liquid ejection head that can easily and accurately identify the characteristics of a piezoelectric element. It is also an object of the present invention to provide a method of inspecting such an actuator device and a liquid ejection head.

In order to achieve the above object, according to the invention, there is provided an actuator device, comprising:

a substrate, formed with at least one pressure generating chamber;

a vibration plate, joined to the substrate so as to form a part of the pressure generating chamber;

at least one first piezoelectric element, disposed on a part of the vibration plate facing the pressure generating chamber, the first piezoelectric element comprising:

- a first electrode, disposed on the part of the vibration plate;
- a first piezoelectric layer, laminated on the first electrode;
- a second electrode, disposed on the first piezoelectric layer;
- a second piezoelectric layer, laminated on the first piezoelectric layer while covering the second electrode; and
- a third electrode, disposed on the second piezoelectric layer and electrically connected to the first electrode; and at least one second piezoelectric element, disposed on the vibration plate, and comprising at least the first piezoelectric layer, the second electrode, and the second piezoelectric layer, such that an electrostatic capacity of either the first piezoelectric layer or the second piezoelectric layer is adapted to be measured, the second piezoelectric element being arranged adjacent to the first piezoelectric element in a first direction corresponding to a shorter width of the first piezoelectric element.

In such a configuration, not only the total electrostatic capacity of the first piezoelectric layer and the second piezoelectric layer of the first piezoelectric element can be measured, but also the electrostatic capacity of either the first piezoelectric layer or the second piezoelectric layer of the second piezoelectric element. Since the electrostatic capacities of the first piezoelectric layer and the second piezoelectric layer of first piezoelectric element can be calculated based on the measurement results, the characteristics of the first piezoelectric element can be identified relatively accurately.

It is preferable that: the second piezoelectric element further comprises the first electrode and the third electrode; either one of the first electrode and the third electrode in the second piezoelectric element is electrically connected to the first electrode and the third electrode in the first piezoelectric element; and the other one of the first electrode and the third electrode in the second piezoelectric element is electrically isolated from the first electrode and the third electrode in the first piezoelectric element.

Alternatively, it is preferable that the second piezoelectric element further comprises either the first electrode or the third electrode.

It is also preferable that: a plurality of first piezoelectric elements are arranged in the first direction; and the second piezoelectric element is arranged adjacent to each of an outermost one of the first piezoelectric elements in the first direction.

Preferably, the first piezoelectric layer and the second piezoelectric layer are formed by printing.

In a case where the piezoelectric layers are formed by printing, the characteristics of the piezoelectric element tend to vary. However, according to the above configuration, the electrostatic capacity of either the first piezoelectric layer or the second piezoelectric layer of the second piezoelectric element need only be measured, to efficiently and accurately identify the characteristics of the first piezoelectric element.

According to the invention, there is also provided a liquid ejection head, comprising:

the above actuator device; and a nozzle plate, formed with a nozzle orifice communicated with the pressure generating chamber to eject liquid contained in the pressure generating chamber therefrom a liquid droplet.

In such a configuration, a liquid ejection head having stabilized liquid ejection characteristics can be implemented.

It is preferable that: the liquid ejection head further comprises a dummy piezoelectric element, adapted not to perform liquid ejection. The second piezoelectric element is provided as the dummy piezoelectric element.

In such a configuration, the electrostatic capacities of the first piezoelectric layer and the second piezoelectric layer of the first piezoelectric element can be measured, even after an actuator unit of the liquid ejection head is assembled. As a result, the manufacturing efficiency is increased remarkably.

According to the invention, there is also provided a method of inspecting the above actuator device, comprising steps of:

measuring a total electrostatic capacity of the first piezoelectric layer and the second piezoelectric layer of the first piezoelectric element;

measuring the electrostatic capacity of either the first piezoelectric layer or the second piezoelectric layer of the second piezoelectric element; and identifying characteristics of the first piezoelectric element based on the total electrostatic capacity and the electrostatic capacity.

Preferably, the inspecting method further comprises a step of identifying thickness dimensions of the first piezoelectric layer and the second piezoelectric layer in the first piezoelectric element to identify the characteristics thereof.

According to the invention, there is also provided a method of inspecting the above liquid ejection head, comprising steps of:

measuring a total electrostatic capacity of the first piezoelectric layer and the second piezoelectric layer of the first piezoelectric element;

measuring the electrostatic capacity of either the first piezoelectric layer or the second piezoelectric layer of the second piezoelectric element; and identifying characteristics of the first piezoelectric element based on the total electrostatic capacity and the electrostatic capacity.

Preferably, the inspecting method further comprises a step of identifying thickness dimensions of the first piezoelectric layer and the second piezoelectric layer in the first piezoelectric element to identify the characteristics thereof.

Preferably, the second piezoelectric element is provided as a dummy piezoelectric element which is adapted not to perform liquid ejection.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

The preferred embodiments of the present invention will now be described in detail with reference to the accompanying drawings.

Figure 1:
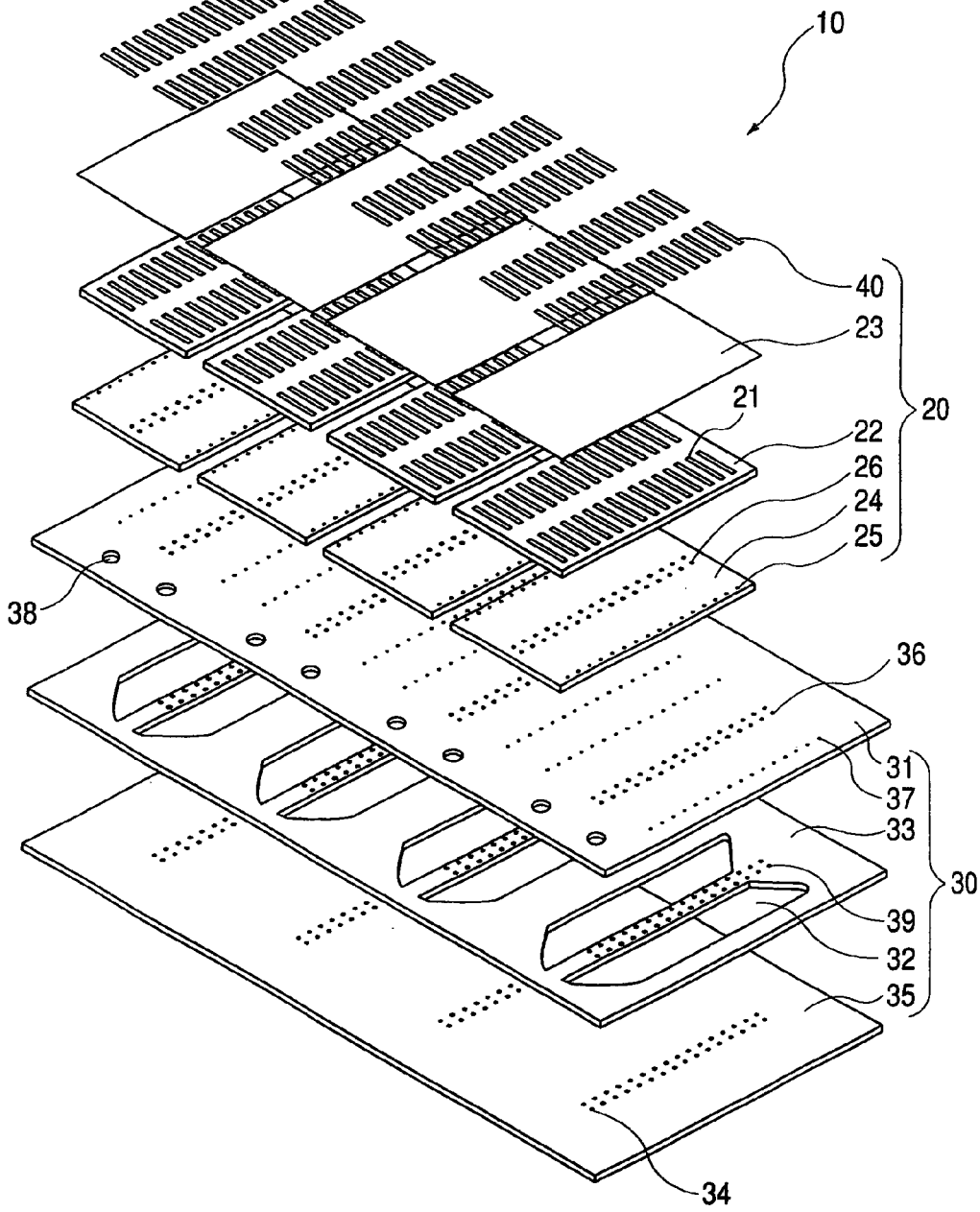
FIG. 1 is an exploded perspective view of a liquid ejection head according to one embodiment of the present invention.
Figure 2A:
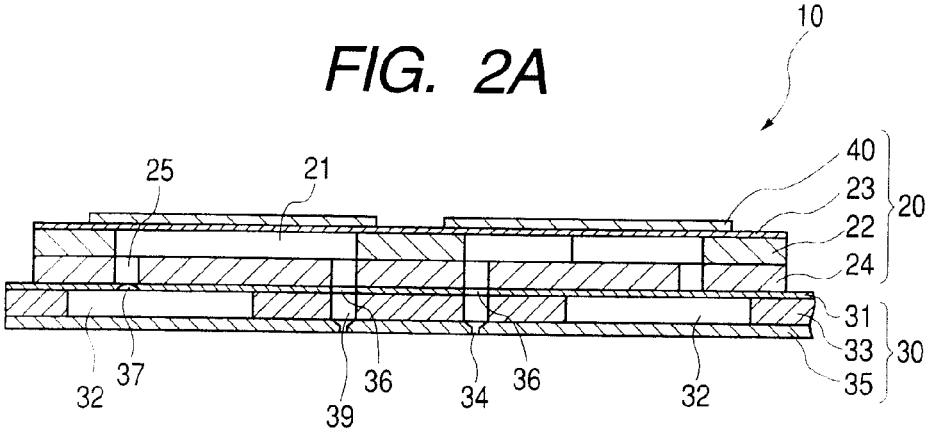
FIG. 2A is a longitudinal section view of the liquid ejection head.
Figure 2B:
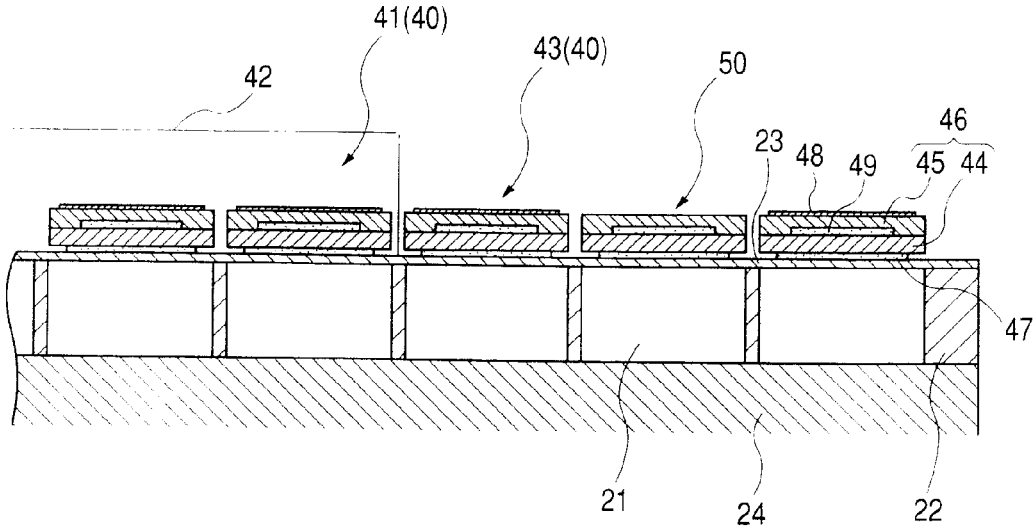
FIG. 2B is a traversal section view of the liquid ejection head.
Figure 3:
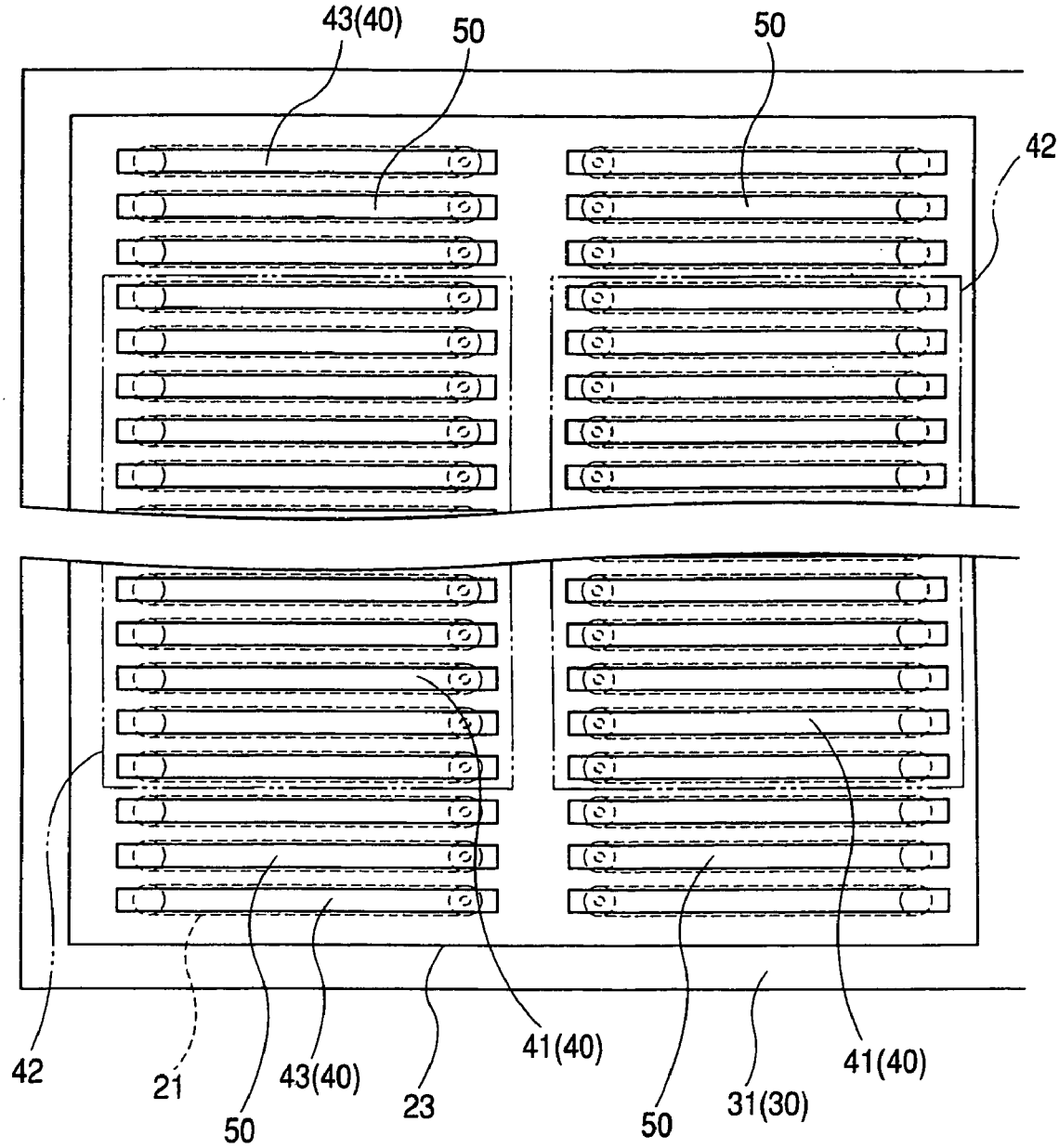
FIG. 3 is a plan view of the liquid ejection head.

As is shown in FIGS. 1 to 3, an ink jet recording head 10 (which is one example of the liquid ejection head) according to one embodiment comprises a plurality, four in this case, of actuator units 20; and one flow path unit 30 to which the four actuator units 4 are fixed.

Each actuator unit 20, which serves as an actuator device, includes: piezoelectric elements 40; a flow path formation substrate 22, in which pressure generating chambers 21 are formed; a vibration plate 23, provided on one side of the flow path formation substrate 22; and a bottom plate 24, provided on the other side of the flow path formation substrate 22.

The flow path formation substrate 22 is a ceramics plate made of zirconia ($ZrO_2$) and having a thickness of about 150 μm. In this embodiment, the pressure generating chambers 21 are arranged in two arrays in the widthwise direction thereof. The vibration plate 23, which is a thin plate of zirconia having a thickness of 10 μm, is fixed to and closes one side of the flow path formation substrate 22.

The bottom plate 24 is fixed to and closes the other side of the flow path formation substrate 22. Included in the bottom plate 24 are supply through holes 25, one of which is formed in the vicinity of one longitudinal end of each of the pressure generating chambers 21, that communicate the pressure generating chambers 21 with a reservoir that will be described later; and nozzle through holes 26, one of which is formed in the vicinity of the other longitudinal end of each of the pressure generating chambers 21, that communicate with nozzle orifices that will be described later.

The piezoelectric elements 40 are arranged so that they occupy portions of the vibration plate 23 corresponding to the respective pressure generating chambers 21. Thus, since in this embodiment there are two arrays of pressure generating chambers 21, two arrays of piezoelectric elements 40 are provided. In addition, dummy piezoelectric elements 43, which do not involve ink ejection, are located at both ends of each array of piezoelectric elements 40. More specifically, as is shown in FIG. 3, drive piezoelectric element groups 42, each of which include a plurality of the piezoelectric elements 40 used for ink ejection, are provided on the vibration plate 23, and at least one dummy piezoelectric element 43 is located outside, at each end, of each drive piezoelectric element group 42. In this embodiment, three dummy piezoelectric elements 43 are provided at each end.

Each of the piezoelectric elements 40 includes: a piezoelectric layer 46 formed by laminating a lower piezoelectric layer 44 and an upper piezoelectric layer 45; a lower common electrode 47 and an upper common electrode 48, which are used in common by a plurality of the piezoelectric elements 40; and a drive electrode 49, which serves as a discrete electrode for each piezoelectric element 40.

The lower common electrode 47 is formed on the surface of the vibration plate 23. On the lower common electrode 47, for each of the pressure generating chambers 21, the lower piezoelectric layer 44 and the upper piezoelectric layer 45 are laminated in this order, while the drive electrode 49 is arranged therebetween. The upper common electrode 48 is arranged on the upper electric layer 45. The upper common electrode 48 and the lower common electrode 47 are electrically connected by wire bonding or soldering.

For the thus arranged piezoelectric elements 40, the polarization direction differs between the lower piezoelectric layers 44 and the upper piezoelectric layers 45. Therefore, when a voltage is applied simultaneously to the lower common electrodes 47 and the upper common electrodes 48, the lower piezoelectric layers 44 and the upper piezoelectric layers 45 are deformed in the same direction, so that the vibration plate 23 is deformed and pressure is exerted in the pressure generating chambers 21.

One of the dummy piezoelectric elements 43 (40), which are arranged outside, at both ends, of each drive piezoelectric element group 42, is employed as an inspection piezoelectric element 50 for measuring the electrostatic capacity of either the lower piezoelectric layer 44 or the upper piezoelectric layer 45. In this embodiment, of the three dummy piezoelectric element 43 (40), the middle one serves as the inspection piezoelectric element 50.

In this embodiment, a corresponding upper common electrode 48 is not provided for the inspection piezoelectric element 50, and thus, only the electrostatic capacity of the lower piezoelectric layer 44 can be measured as described later in detail.

Figure 4A:
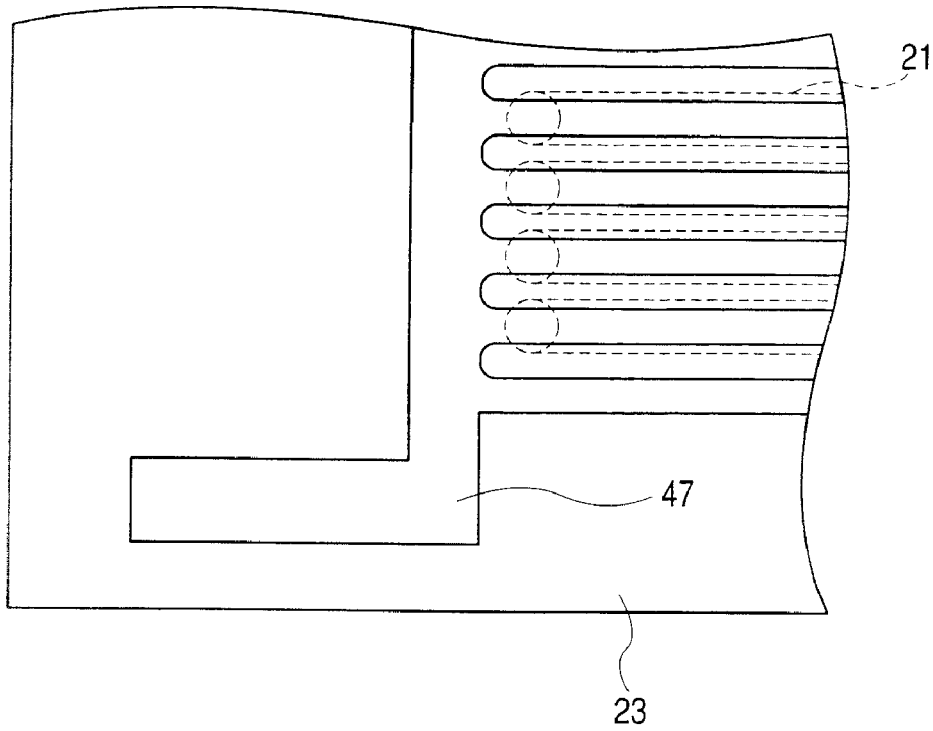
FIG. 4A is a plan view showing the shape of a lower common electrode in the liquid ejection head.

That is, as is shown in FIG. 4A, the lower common electrode 47 is arranged in an area facing the pressure generating chambers 21. Further, the lower common electrode 47 extends outward across one longitudinal end of each pressure generating chamber 21 to be integrated at the area corresponding to the outside of the pressure generating chambers 21. As a result, the lower common electrode 47 has a substantially pectinated shape.

Figure 4B:
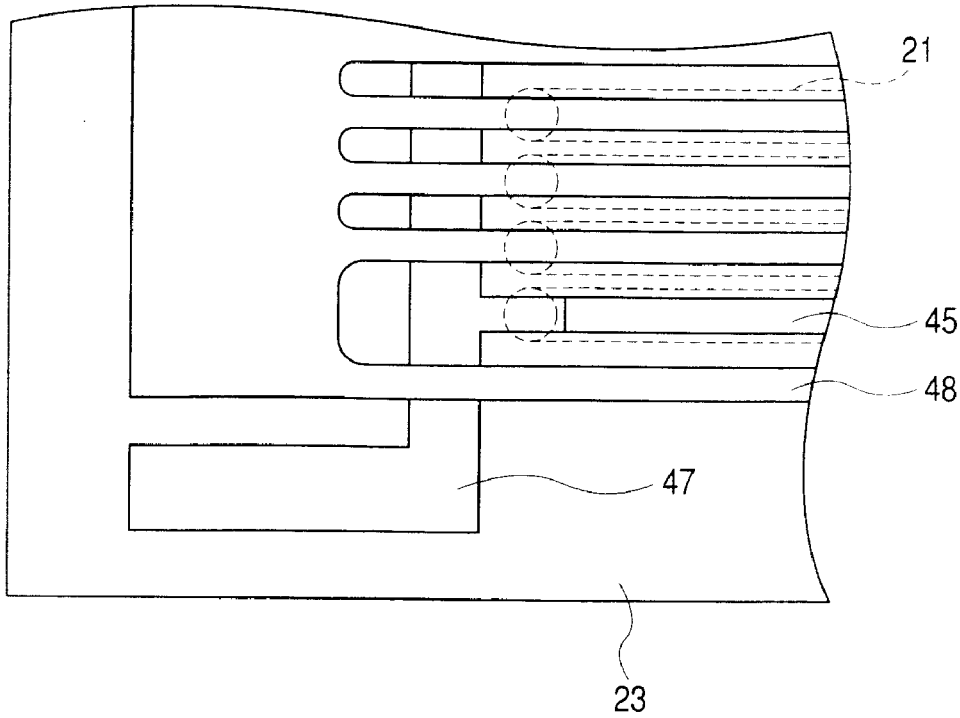
FIG. 4B is a plan view showing the shape of an upper common electrode in the liquid ejection head.

Similarly, as is shown in FIG. 4B, the upper common electrode 48 is also arranged in an area facing the pressure generating chambers 21, and extends outward across one longitudinal end of each pressure generating chamber 21 to be integrated at the area corresponding to the outside of the pressure generating chambers 21. Thus, the upper common electrode 48, as well as the lower common electrode 47, has a substantially pectinated shape. However, since the upper common electrode 48 does not cover the area constituting the inspection piezoelectric element 50, the surface of the upper piezoelectric layer 45, which constitutes the inspection piezoelectric element 50, is exposed.

In this embodiment, two arrays of the drive piezoelectric element groups 42 are provided, and the inspection piezoelectric element 50 is located outside, at both ends, of each drive piezoelectric element group 42. Therefore, an inspection piezoelectric element 50 is arranged at each corner of the flow path formation substrate 22.

As will be described in detail later, since the inspection piezoelectric element 50 is provided, the characteristics of the piezoelectric element 40 can be accurately identified, and an ink jet recording head having a satisfactory ink ejection characteristic can be easily manufactured.

Each of the thus arranged actuator units 20 is provided as an integral unit through the lamination and sintering of the ceramic flow path formation substrate 22, the vibration plate 23 and the bottom plate 24, and thereafter, the piezoelectric elements 40 are formed on the vibration plate 23. The method used to form the piezoelectric element 40 will be described later in detail.

The flow path unit 30 comprises: a supply port formation substrate 31, which is bonded to the bottom plates 24 of the actuator units 20; a reservoir formation substrate 33, in which reservoirs 32 are formed to serve as a common ink chamber used by the pressure generating chambers 21; and a nozzle plate 35, in which nozzle orifices 34 are formed. In this embodiment, the flow path unit 30 is so designed that the four actuator units 20 can be fixed thereto.

The supply port formation substrate 31 is a thin plate made of zirconia having a thickness of 150 μm, in which are formed: nozzle through holes 36 that communicate the nozzle orifices 34 with the pressure generating chambers 21; ink supply ports 37 that, as well as the supply through holes 25, communicate the reservoirs 32 with the pressure generating chambers 21; and ink introduction ports 38 that communicate with the reservoirs 32 to supply ink from an external ink tank.

The reservoir formation substrate 33 is a plate made of a resist material, such as a stainless steel, that is appropriate for forming an ink flow path. The reservoirs 32, through which ink supplied from an external ink tank (not shown) is fed to the pressure generating chambers 21, and nozzle through holes 39, which connect the pressure generating chambers 21 and the nozzle orifices 34, are formed in the reservoir formation substrate 33.

The nozzle plate 35 is a thin plate made of stainless steel, in which the nozzle orifices 34 are formed at the same pitches as those of the pressure generating chambers 21. In this embodiment, since the four actuator units 20 are fixed to the flow path unit 30, eight arrays of nozzle orifices 34 are formed in the nozzle plate 35. The nozzle plate 35 is bonded to the face of the reservoir formation substrate 33, opposite the flow path formation substrate 22, and closes one side for the reservoirs 32.

The thus arranged flow path unit 30 is provided by gluing together, using an adhesive, the supply port formation substrate 31, the reservoir formation substrate 33 and the nozzle plate 35. In this embodiment, the reservoir formation substrate 33 and the nozzle plate 35 are made of stainless steel; however, these plates may be formed of ceramics, so that the flow path unit 30 may be integrally formed in the same manner for the actuator unit 20.

When a predetermined number, i.e., four, of the actuator units 20 are bonded to the thus arranged flow path unit 30, the ink jet recording head 10 in this embodiment is obtained.

A detailed explanation will now be given for a method for manufacturing the ink jet recording head of this embodiment, especially a method for manufacturing the actuator unit.

Figure 5A:
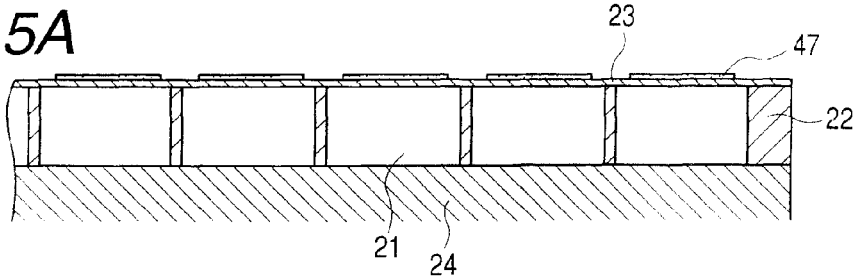
FIGS. 5A to 5E are traversal section views showing the process for manufacturing piezoelectric elements in the liquid ejection head.

First, the flow path formation substrate 22, the vibration plate 23 and the bottom plate 24, which have predetermined shapes, are integrally formed by baking, and the bonded structure is obtained. Then, as is shown in FIG. 5A, the lower common electrode 47 is deposited on the surface of the vibration plate 23. In this embodiment, printing is used to deposit the lower common electrode 47, which is thereafter baked. That is, a mask is mounted at a predetermined position on the vibration plate 23, and using printing, a coating of platinum paste is applied, through the mask, to the surface of the vibration plate 23. Then, the bonded structure, whereon the coating of platinum paste is applied in a baking furnace, and is baked at a predetermined temperature for a predetermined time period. Through the baking, the lower common electrode 47, having the pectinated shape, is deposited on the surface of the vibration plate 23.

While a conductive material, such as a metal, an alloy, or an alloy of insulating ceramics and metal, can be employed for the lower common electrode 47. In this embodiment, platinum is employed to prevent a defect, such as alteration, from occurring at the baking temperature. The similar type of material can be employed for the upper common electrode 48 and the drive electrode 49, and in this embodiment, gold is employed for the upper common electrode 48 and platinum is employed for the drive electrode 49.

Figure 5B:
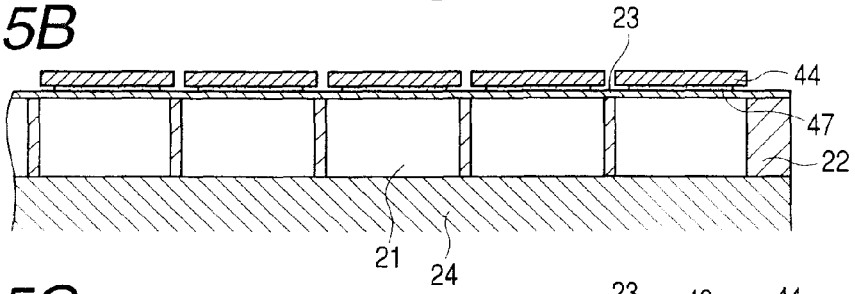

Next, as is shown in FIG. 5B, the lower piezoelectric layers 44 are formed. That is, after the mask has been located at the predetermined position for the vibration plate 23, coatings of piezoelectric (e.g., lead zirconate titanate) pastes are applied to the lower common electrode 47, and are baked to form the lower piezoelectric layers 44.

Figure 5C:
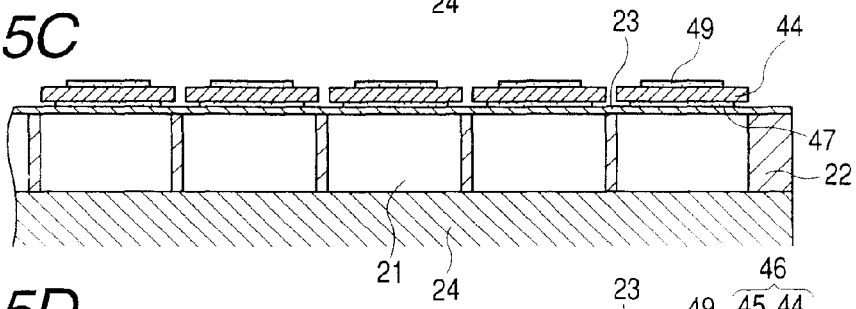
Figure 5D:
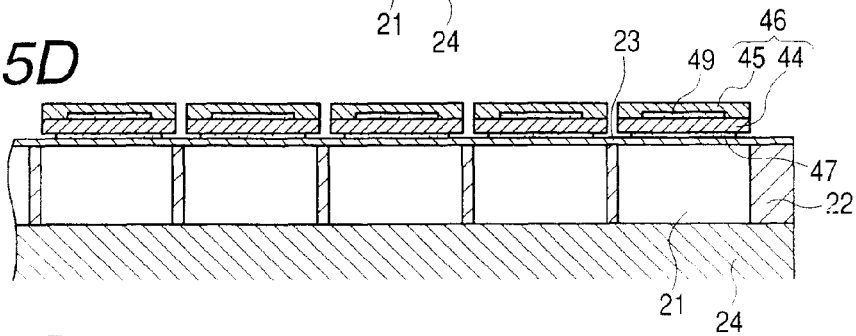
Figure 5E:
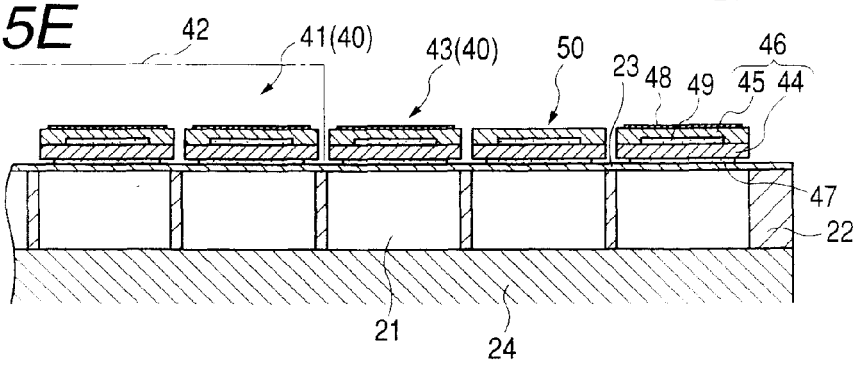

Thereafter, in the same manner, the drive electrode 49, the upper piezoelectric layer 45 and the upper common electrode 48 are formed in the named order. Specifically, as is shown in FIG. 5C, coatings of platinum pastes are applied to the lower piezoelectric layers 44, and are baked to form the drive electrodes 49. Following this, as is shown in FIG. 5D, coatings of piezoelectric pastes are applied to lower piezoelectric layers 44 so as to cover the drive electrodes 49, and are baked to form the upper electrode layers 45. Furthermore, as is shown in FIG. 5E, a coating of a gold paste is applied to cover the surfaces of the upper piezoelectric layers 45, and is baked to form the upper common electrode 48.

Although not shown, the lower common electrode 47 and the upper common electrode 48 are electrically connected by wire bonding or soldering to obtain the actuator unit 20.

When the actuator unit 20 is provided in this manner, an inspection process is performed to determine whether the individual layers constituting the piezoelectric element 40 have been manufactured normally. In this embodiment, the electrostatic capacity that correlates with the size (e.g., the thickness or the width) of the piezoelectric layer 46 is measured for the piezoelectric element 40. In this embodiment, a measurement of the electrostatic capacity between the drive electrode 49 and the lower common electrode 47 is performed.

Figure 6A:
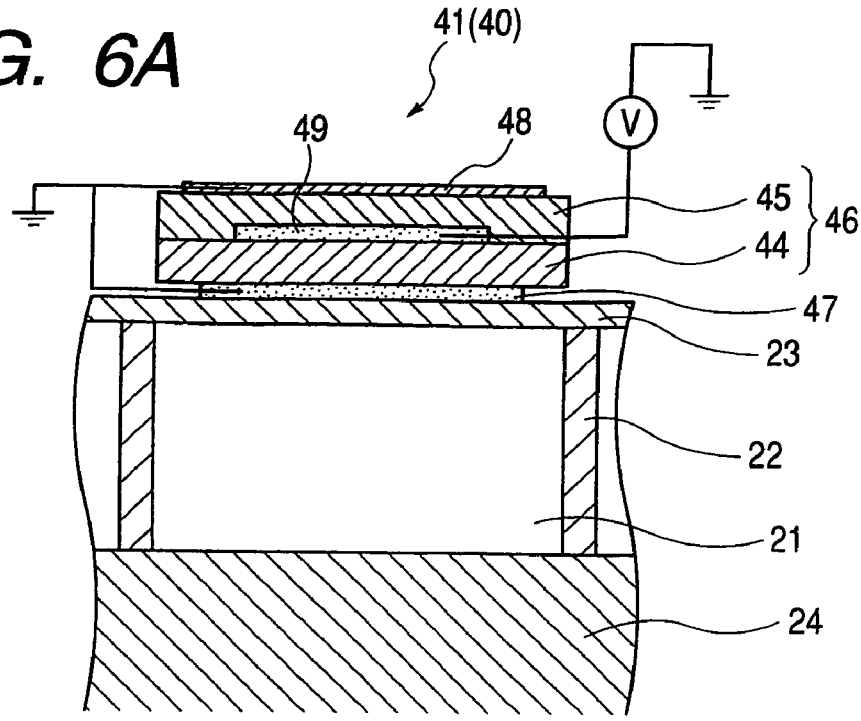
FIG. 6A is a traversal section view showing an inspection process of a drive piezoelectric element group in the liquid ejection head.
Figure 6B:
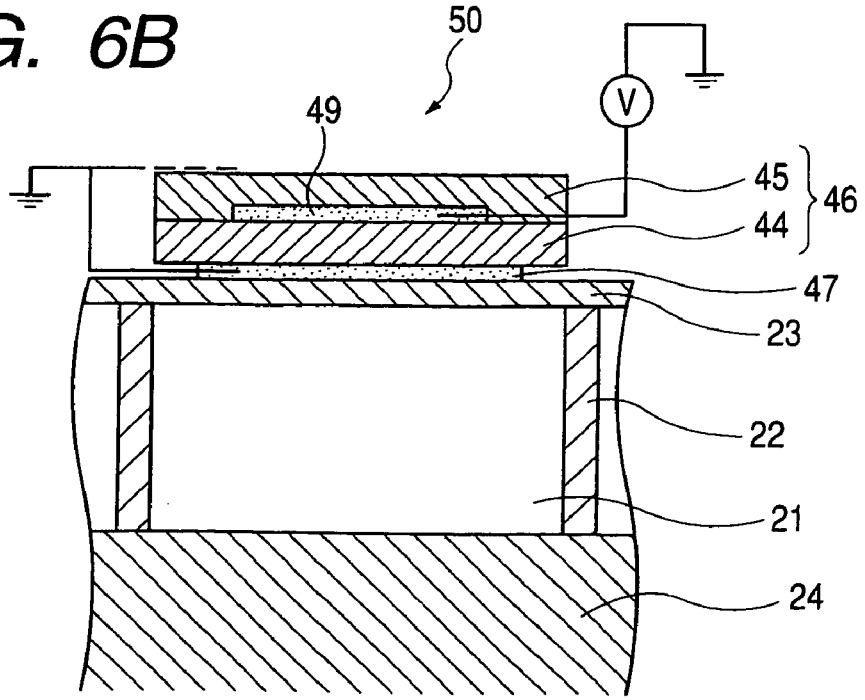
FIG. 6B is a traversal section view showing an inspection process of an inspection piezoelectric element in the liquid ejection head.

As is shown in FIG. 6A, for each of the piezoelectric elements 41 (40) of the drive piezoelectric element groups 42, the lower common electrode 47 and the upper common electrode 48 are connected. Thus, when the electrostatic capacity between the drive electrode 49 and the lower common electrode 47 is measured, the electrostatic capacity of the entire piezoelectric layer 46, i.e., the total electrostatic capacities of the lower piezoelectric layer 44 and the upper piezoelectric layer 46 can be measured. On the contrary, as is shown in FIG. 6B, since the upper common electrode 48 is not provided for each of the inspection piezoelectric elements 50, only the electrostatic capacity of the lower piezoelectric layer 44 is obtained by measuring the electrostatic capacity between the drive electrode 49 and the lower common electrode 47.

As is described above, since not only the overall electrostatic capacity of the piezoelectric layer 46 that constitutes each piezoelectric element 40 is measured, but also, by using the inspection piezoelectric element 50, the electrostatic capacity of only the lower piezoelectric layer 44 is measured, the electrostatic capacities of both the lower piezoelectric layer 44 and the upper piezoelectric layer 45 of the piezoelectric element 40 can substantially be obtained.

Specifically, the electrostatic capacities of the lower piezoelectric layer 44 and the upper piezoelectric layer 45 of each of the piezoelectric elements 41 (40) of the drive piezoelectric element groups 42 can be obtained by referring to the electrostatic capacity of the lower piezoelectric layer 44, which is measured by using the inspection piezoelectric element 50. Therefore, even when the electrostatic capacities of the lower piezoelectric layer 44 and the upper piezoelectric layer 45 are not measured for each piezoelectric element 41 (40), the characteristic of the piezoelectric element 40 can be identified relatively accurately.

In this embodiment, since the inspection piezoelectric element 50 is provided at the four corners of the flow path formation substrate 22, only the electrostatic capacities of the lower piezoelectric layers 44 of the four inspection piezoelectric elements 50 need be measured, and the difference between these capacities referred to. Thus, the electrostatic capacities of the lower piezoelectric layer 44 and the upper piezoelectric layer 45 of each piezoelectric element 41 (40) can be accurately calculated.

In this embodiment, since the dummy piezoelectric elements 43 that do not eject ink are used as the inspection piezoelectric elements 50, the electrostatic capacities of the lower piezoelectric layer 44 and the upper piezoelectric layer 45 of each piezoelectric element 40 can be measured, even after the actuator unit 20 is assembled. As a result, the manufacturing efficiency is increased remarkably.

In this embodiment, the dummy piezoelectric elements 43 for which the upper common electrode 48 is not provided have been employed as the inspection piezoelectric elements 50. However, the invention is not limited to this arrangement, and an upper common electrode may be formed for the inspection piezoelectric elements 50, so long as it is electrically disconnected from the upper common electrode 48 for the other piezoelectric elements 40.

Furthermore, in this embodiment, the electrostatic capacity of the lower piezoelectric layer 44 of the inspection piezoelectric element 50 has been measured. However, only the electrostatic capacity of either the lower piezoelectric layer or the upper piezoelectric layer need be measured. Therefore, the lower common electrode may not be provided for the inspection piezoelectric element, so that only the measurement of the electrostatic capacity of the upper piezoelectric layer is enabled for the inspection piezoelectric element.

When this inspection process is finished, the measured electrostatic capacities are employed to determine whether or not the actuator unit 20 is defective. The actuator units 20 that are determined not to be defective are classified in ranks based on the obtained electrostatic capacity, such as the average electrostatic capacity of each actuator unit 20, or the variance range of the electrostatic capacities. In this embodiment, the actuator units 20 are classified using ten levels that are based on the average electrostatic capacity.

Also in this embodiment, the resonant frequency of each piezoelectric element is measured, and for the actuator units 20, not only ranking based on the electrostatic capacity, but also ranking based on the resonant frequency is performed That is, to classify the actuator units 20, 40 ranks are employed.

After the actuator units 20 are classified in this manner, the process for polarizing each of the piezoelectric elements 40 is performed. For this process, the upper common electrode 48 and the lower common electrode 47 are grounded, the drive electrode 49 is connected to a power source, and a voltage (polarization voltage) sufficiently higher than a drive voltage that is to be employed is applied to the piezoelectric elements 40. In this embodiment, the drive voltage is set to around 30 V, and the polarization voltage is set to around 70 V. And when the polarization process is terminated, actuator units 20 in the same rank are selected and are bonded to the flow path unit 30. As a result, the ink jet recording head 10 is provided.

As is described above, in this embodiment, the actuator units 20 are ranked based on the electrostatic capacity of the piezoelectric layer 46, i.e., based on the electrostatic capacities of the lower piezoelectric layer 44 and the upper piezoelectric layer 45, and the actuator units 20 having the same rank are assembled to form the ink jet recording head 10. Therefore, only the same drive waveform need be supplied to the piezoelectric elements 41 (40) to enable ink droplets to be ejected through the nozzle orifices 34 under the same ink ejection characteristics, and the printing quality is considerably increased.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

For example, the inspection piezoelectric elements may be located at positions other than at both ends of each piezoelectric element group, so long as they are arranged in the widthwise direction of the piezoelectric elements, together with the drive piezoelectric element group.

Further, while in this embodiment four actuator units have been fixed to one flow path unit, a single actuator unit may be fixed to each flow path unit.

Furthermore, while in this embodiment the ink jet recording head comprising the actuator device has been explained, the present invention can also be applied for an actuator device that is mounted on a liquid ejection head, such as: a color material ejection head used for manufacturing color filters incorporated in liquid crystal displays; an electrode material ejection head for manufacturing electrodes incorporated in organic EL displays and field emission displays; and a bio-organic substance ejection head for manufacturing biochips.

What is claimed is:

1. An actuator device, comprising:

a substrate, formed with a pressure generating chamber;

a vibration plate, joined to the substrate so as to form a part of the pressure generating chamber;

a first piezoelectric element, disposed on a part of the vibration plate facing the pressure generating chamber, the first piezoelectric element comprising:

a first electrode, disposed on the part of the vibration plate;

a first piezoelectric layer, laminated on the first electrode;

a second electrode, disposed on the first piezoelectric layer;

a second piezoelectric layer, laminated on the first piezoelectric layer while covering the second electrode; and a third electrode, disposed on the second piezoelectric layer and electrically connected to the first electrode; and a second piezoelectric element, disposed on the vibration plate and arranged adjacent to the first piezoelectric element, the second piezoelectric element comprising:

a third piezoelectric layer, directly disposed on the vibration plate;

a fourth electrode, disposed on the third piezoelectric layer;

a fourth piezoelectric layer, laminated on the third piezoelectric layer while covering the fifth electrode; and a fifth electrode, disposed on the fourth piezoelectric layer and electrically connected to the first electrode and the third electrode.

2. A liquid ejection head, incorporating the actuator device as set forth in claim 1, comprising a nozzle plate formed with a nozzle orifice communicated with the pressure generating chamber to eject liquid contained therein.

3. The liquid ejection head as set forth in claim 2, further comprising a dummy piezoelectric element adapted not to perform liquid ejection, wherein the second piezoelectric element is provided as the dummy piezoelectric element.

4. A method of inspecting an actuator device, comprising:

providing an actuator device as set forth in claim 1;

measuring a total electrostatic capacity of the first piezoelectric layer and the second piezoelectric layer;

measuring an electrostatic capacity of the fourth piezoelectric layer;

identifying characteristics of the first piezoelectric element based on the total electrostatic capacity and the electrostatic capacity; and outputting the characteristics and determining whether or not the actuator device is defective based on the output characteristics.

5. The inspection method as set forth in claim 4, further comprising identifying thickness dimensions of the first piezoelectric layer and the second piezoelectric layer to identify the characteristics thereof.

* * * * *